US010435886B2

(12) United States Patent
Lafontaine Berger

(10) Patent No.: US 10,435,886 B2
(45) Date of Patent: Oct. 8, 2019

(54) DECK

(71) Applicant: Stephane Lafontaine Berger, St-Jean-sur-Richelieu (CA)

(72) Inventor: Stephane Lafontaine Berger, St-Jean-sur-Richelieu (CA)

( * ) Notice: Subject to any disclaimer, the term of this patent is extended or adjusted under 35 U.S.C. 154(b) by 0 days.

(21) Appl. No.: 15/998,384

(22) Filed: Aug. 14, 2018

(65) Prior Publication Data

US 2018/0347190 A1 Dec. 6, 2018

Related U.S. Application Data

(63) Continuation-in-part of application No. 15/731,050, filed on Apr. 11, 2017, now abandoned.

(51) Int. Cl.

| | |
|---|---|
| ***E04B 5/12*** | (2006.01) |
| ***E04B 1/26*** | (2006.01) |
| ***E04F 15/02*** | (2006.01) |
| ***E04F 15/024*** | (2006.01) |
| *E04B 1/00* | (2006.01) |
| *E04B 1/24* | (2006.01) |

(52) U.S. Cl.

CPC ..... *E04B 5/12* (2013.01); *E04B 1/2604* (2013.01); *E04F 15/02183* (2013.01); *E04F 15/02452* (2013.01); *E04F 15/02458* (2013.01); *E04B 1/003* (2013.01); *E04B 2001/2406* (2013.01); *E04B 2001/2415* (2013.01); *E04B 2001/2418* (2013.01); *E04B 2001/2652* (2013.01); *E04B 2001/2676* (2013.01)

(58) Field of Classification Search

CPC .... E04B 5/12; E04B 1/003; E04B 2001/2652; E04B 2001/2415; E04B 2001/2406; E04B 2001/2418; E04B 2001/2676; E04B 1/26–4; E04F 15/02183

USPC ..... 52/579

See application file for complete search history.

(56) References Cited

U.S. PATENT DOCUMENTS 2,803,321 A * 8/1957 Fox-Williams ..... E04D 3/08 52/459
3,332,192 A * 7/1967 Kessler ..... E04C 2/54 24/700
4,304,073 A * 12/1981 Reith ..... A47B 96/1458 108/108

(Continued)

FOREIGN PATENT DOCUMENTS

CA 2866534 A1 * 4/2016 ..... E04B 1/003

*Primary Examiner* — Jeanette E Chapman
(74) *Attorney, Agent, or Firm* — Eric Fincham

(57) ABSTRACT

A support structure having a horizontal surface such as a deck or stage, the support structure having first and second modules which are interconnected together, the interconnection comprising a connector assembly having a first member with a vertically extending recess formed within a bottom wall thereof, the recess being bounded by first and second interior walls which each have a protrusion extending inwardly within the recess, and a second member comprising a U-shaped element having a base, first and second legs, each of the legs having an interior and an exterior wall with one of the legs having a recess formed in each of the interior and exterior walls such that the first leg sidingly fits within the recess formed within the first member and the second leg extends upwardly adjacent one of the first and second side walls to receive and support an adjacent module.

2 Claims, 17 Drawing Sheets

(56) References Cited

U.S. PATENT DOCUMENTS

| | | | | |
|---|---|---|---|---|
| 5,215,802 | A * | 6/1993 | Kaars Sijpesteijn | A47L 23/24 15/215 |
| 8,925,271 | B1 * | 1/2015 | Bilge | E04B 1/40 52/506.05 |
| 2009/0139151 | A1 * | 6/2009 | Quam | F16B 12/42 52/7 |
| 2015/0267398 | A1 * | 9/2015 | Hawk | E04F 13/0733 52/718.04 |

* cited by examiner

DECK

The present application is a continuation-in-part of application Ser. No. 15/731,050 filed Apr. 11, 2017, the teachings of which are hereby incorporated by reference.

FIELD OF THE INVENTION

The present invention relates to a horizontal structure which may be used to support various items and/or people, such horizontal support structures typically being known as stages, decks and the like.

BACKGROUND OF THE INVENTION

Most support structures having a horizontal surface are essentially similar in nature. They carry different names depending upon the function which they are to perform. Thus, temporary stages which may be erected and later disassembled are well known in the art. They are typically used during performances by artists or the like. The flooring of the stage is generally at an elevated level and is supported by legs or a similar structure.

A deck is also a support structure having a horizontal surface and is more commonly associated with a residence or the like. The deck may be either a single level or constructed to be multi levels. Again, the horizontal structure is supported at a desired height by legs or the like.

There are many proposals in the art for both decks and stages. These can range from assembling a single module or utilizing a multi modular approach which allows the stage or deck to be easily assembled and later disassembled.

SUMMARY OF THE INVENTION

According to one aspect of the present invention, there is provided a connector assembly comprising a first member having a first side wall, a second side wall, a top wall and a bottom wall, an opening in the bottom wall, the opening communicating with a vertically extending recess formed within the bottom wall, the recess being bounded by first and second interior walls, each of the first and second interior walls and having a protrusion extending inwardly within the recess towards an opposite interior wall, a second member comprising a U-shaped element, the U-shaped element having a base, first and second legs, each of the base and first and second legs having an interior and an exterior wall, the first leg having a recess formed in each of the interior and exterior walls, the arrangement being such that the first leg sidingly fits within the recess within the first member, whereby the protrusions on the interior walls engage within the recesses formed in the interior and exterior walls of the first leg, the second leg of the second element extending upwardly adjacent and spaced from one of the first or second side walls to receive and support an adjacent module.

According to a further aspect of the present invention, there is provided a support structure having a horizontal surface, the support structure comprising first and second modules, the first and second modules each having a rectangular configuration with each module having a side wall, one of the side walls having a connector assembly formed therein, the connector assembly comprising a first member having a first side wall, a second side wall, a top wall and a bottom wall, an opening in the bottom wall, the opening communicating with a vertically extending recess formed within the bottom wall, the recess being grounded by first and second interior walls, each of the first and second interior walls having a protrusion extending inwardly within the recess towards an opposite interior wall, a second member comprising a U-shaped element, the U-shaped element having a base, first and second legs, each of the base and first and second legs having an interior and an exterior wall, the first leg having a recess formed in each of the interior and exterior walls, the arrangement being such that the first leg sidingly fits within the recess within the first member, whereby the protrusions on the interior walls engage within the recesses formed in the interior and exterior walls of the first leg, the second leg of the second element extending upwardly adjacent and spaced from one of the side walls to receive and support a side wall of the second module.

A basis for the horizontal support structure is a plurality of longitudinally extending members which are assembled together in a modular arrangement. The size of the modules may vary with typical sizes being 2×4; 4×4; 2×8; 4×8; etc.

Each of the modules will include at least one support truss. The support trusses can be made of any desired material, and in the prior art most comprise a wood support truss. However, in the preferred embodiment of the present invention, there is provided a metallic support truss and preferably a support truss formed of an aluminum material.

In connection with the above, there will be provided adjustable legs which are known in the art. Bolts may be utilized to connect the adjustable legs.

In addition to the above, the modular arrangement may utilize positioning pins, screws, and the like, all of which are known in the art.

Typically, the units are assembled upside down using a truss which is attached to the other materials by screws and the like.

The surface material may be selected from many known materials. These can vary from wood to various plastic and metallic materials. In one embodiment of the present invention, particularly when the structure is to be used as a deck in a backyard, a material having an imprinted wood finish is desirable. Alternatively, wood per se may be utilized. Some wood structures may include exotic woods including, for example, dragon wood, mora, amarillo, amargo, cumaru.

The modules are held together along their sides or ends using a connector assembly. A preferred embodiment of a connector assembly is shown in the accompanying drawings.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
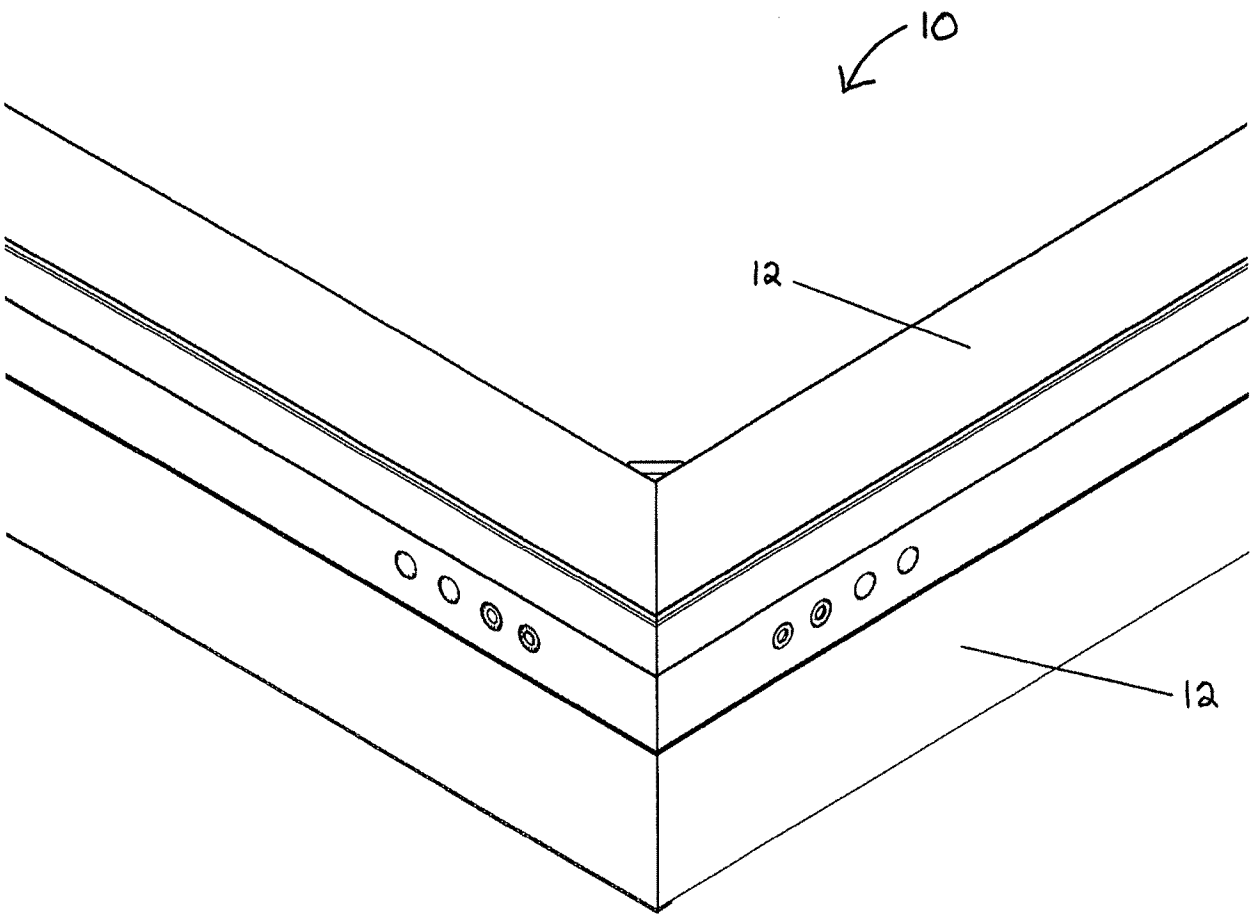
FIG. 1 is a perspective view of a portion of a frame at a corner of the deck component.
Figure 2:
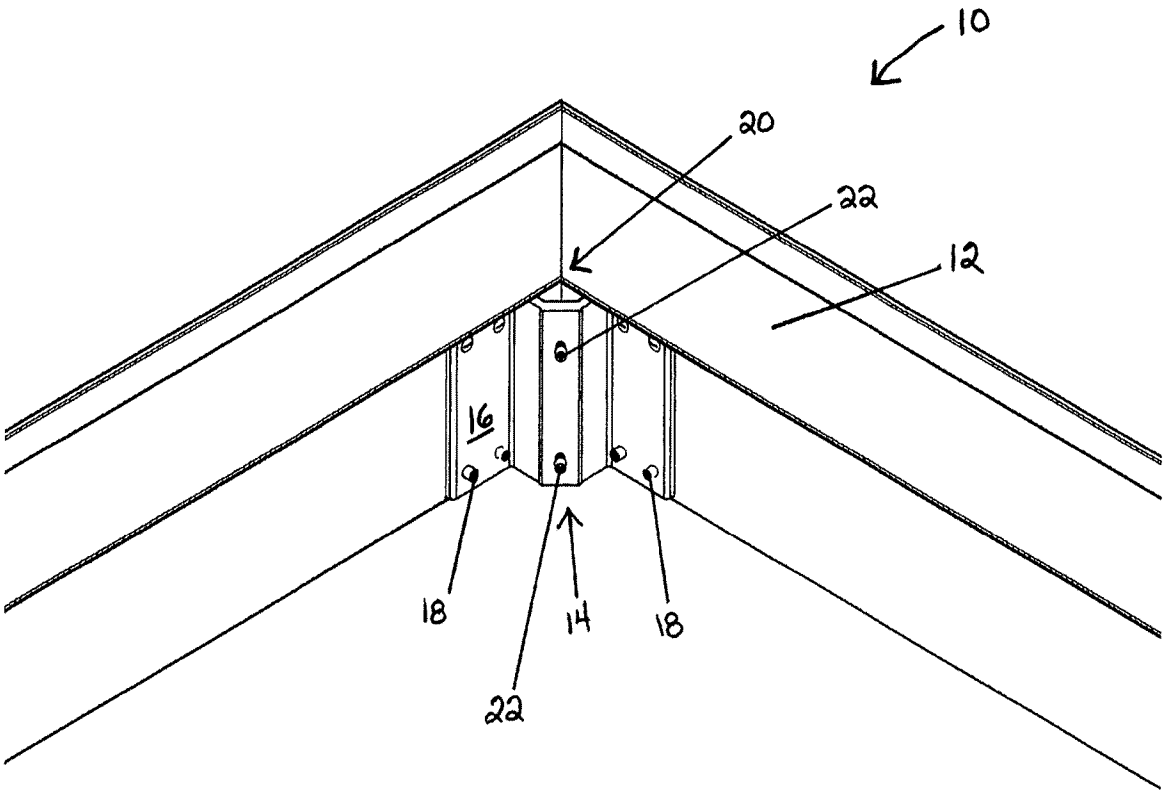
FIG. 2 is a perspective view of the frame corner from the inside thereof.
Figure 3:
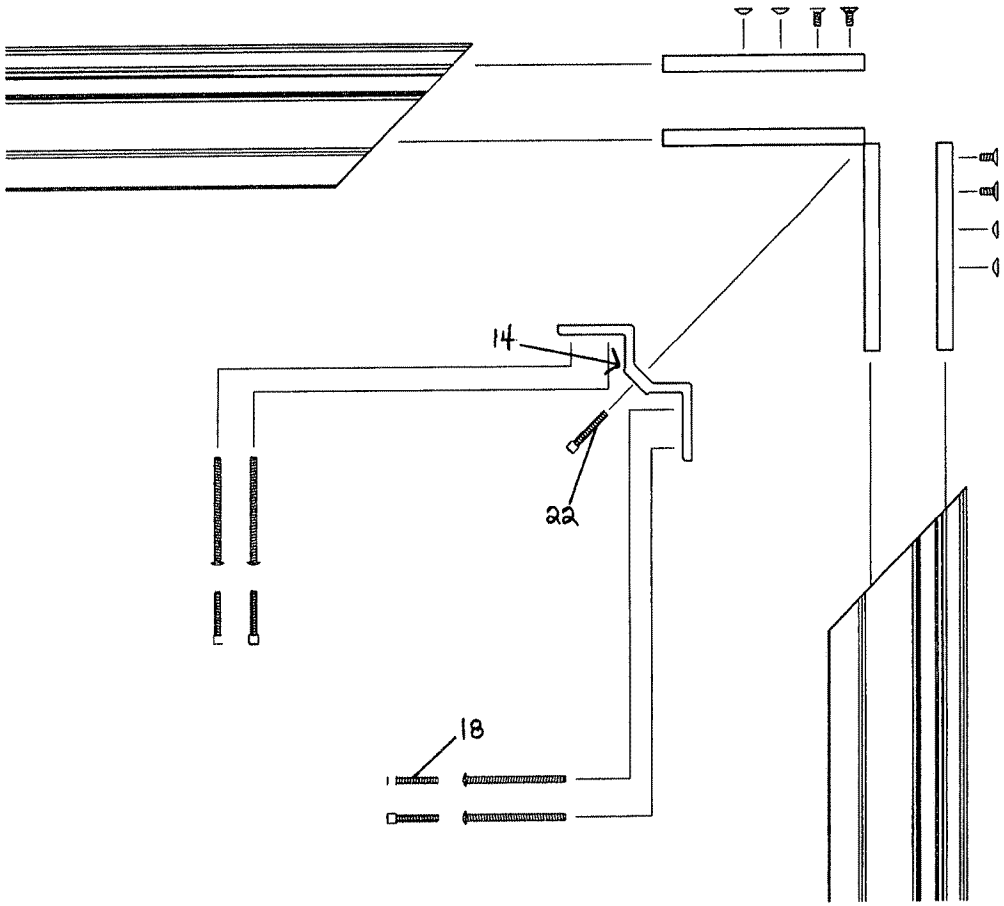
FIG. 3 is a bottom perspective view thereof.
Figure 4:
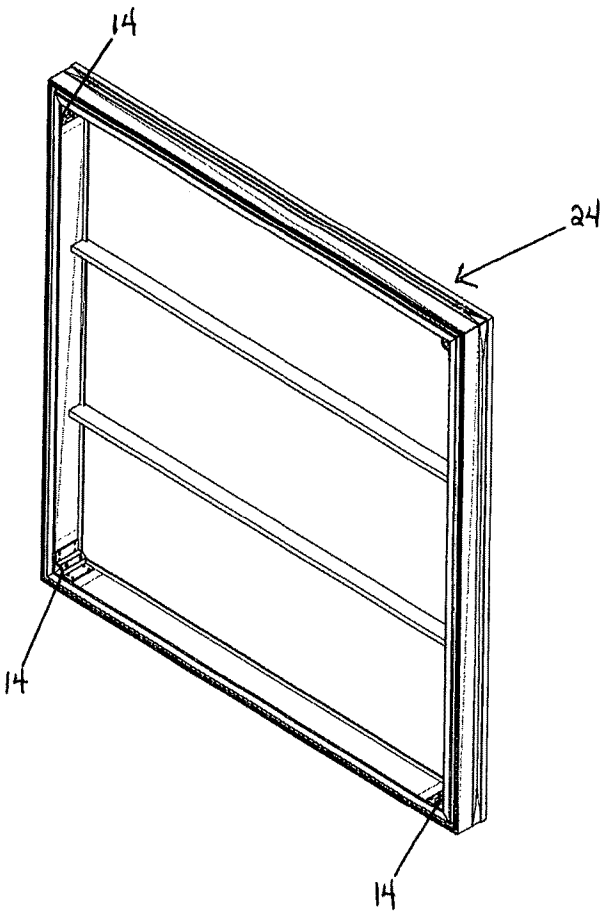
FIG. 4 is a perspective of a single unit which may form a portion of a deck.

Referring to the drawings in greater detail and by reference characters thereto, there is illustrated in FIGS. 1 to 3 a portion of frame 10. As illustrated, there is a plurality of frame members generally designated by reference numeral 12. A leg receptor generally designated by reference numeral 14 is formed on the interior of a corner. Leg receptor 14 includes a pair of attachment plates 16 which are secured to the frame member 12 by means of bolts 18. As will be noted, there is an overlapping portion 20 which abuts the end of a leg inserted in leg receptor 14. Bolts 22 are used to secure a leg (not shown) in leg receptor 14. As shown in FIG. 4, a single unit 24 of a stage or deck will have a plurality of leg receptors 14 situated at the corners and optionally along one or more sides thereof.

Figure 5:
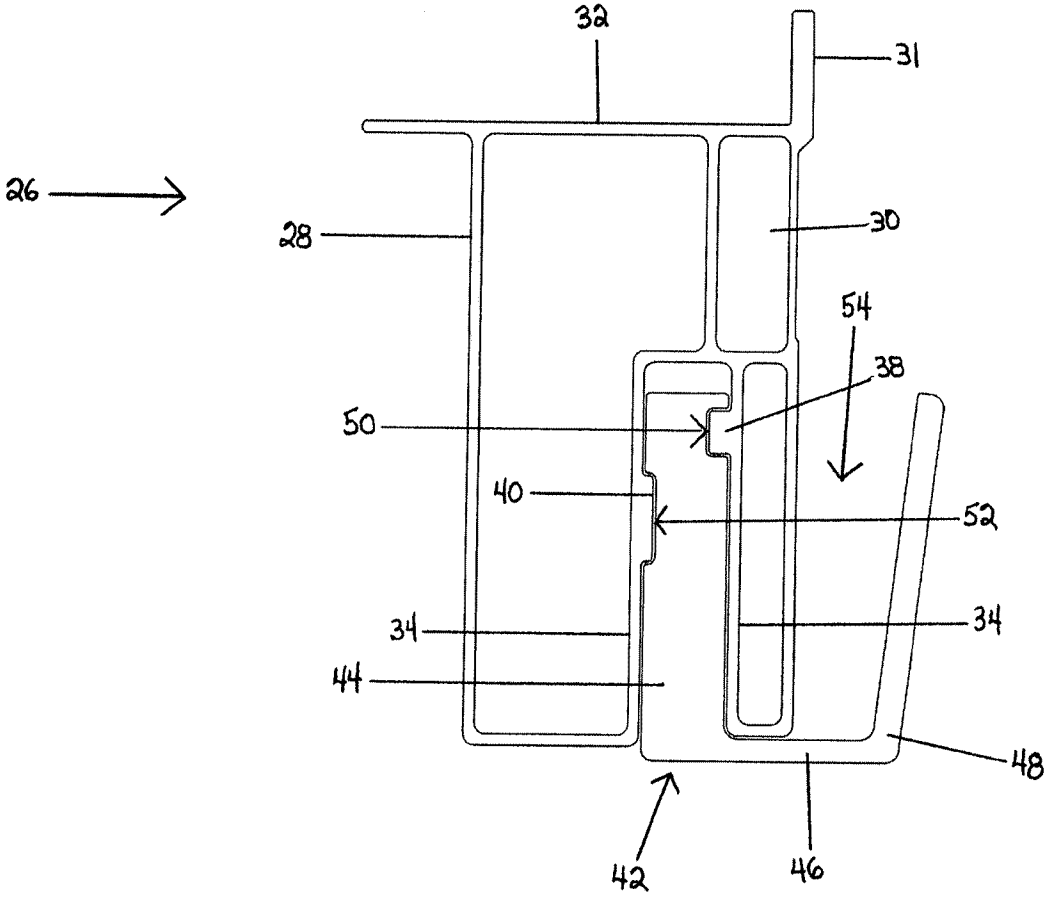
FIG. 5 is a sectional view illustrating the connection of one unit to an adjacent unit.
Figure 6:
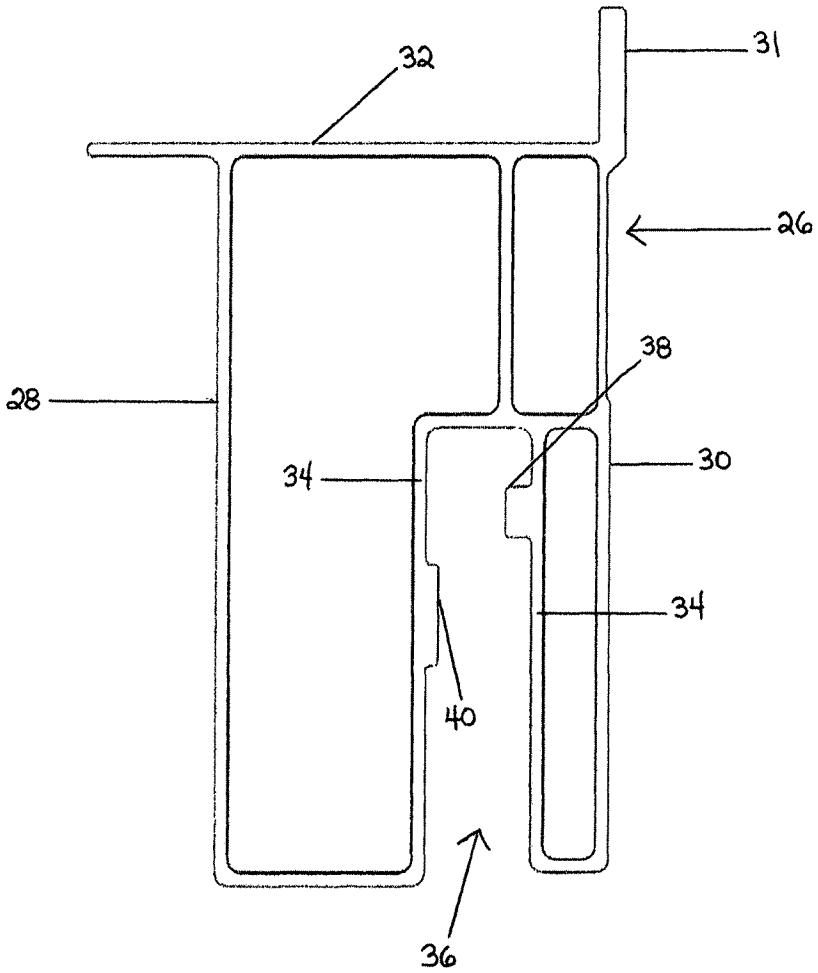
FIG. 6 is a sectional view illustrating the side frame member.

A connector assembly designated by reference numeral 26 is best seen in FIGS. 5 and 6 and reference will now be made thereto. Connector assembly 26 forms a portion of frame member 12 which has an inner wall 28 and an outer wall 30. A top wall 32 is provided upon which the finishing surface such as wood or a metallic sheet material may be placed with extension 31 retaining the sheet material in place.

Frame member 12 includes a pair of inner spaced walls 34 to thereby define a recess 36. On one of the inner walls 34 there is provided a first protrusion 38 while on a facing wall there is provided a second protrusion 40.

A connector element generally designated by reference numeral 42 has a first leg 44, a second leg 46 and a third leg 48. First leg 44 includes recesses 50 and 52 on opposite sides thereof. Recesses 50 and 52 are designed to engage protrusions 38 and 40. As may be seen in FIG. 5, when connector element 42 is placed in position within recess 36, it may slide and is retained in position. Third leg 48, in conjunction with outer wall 30 defines a channel 54 or recess which is designed to receive an outer wall 30 of an adjacent unit.

Figure 7:
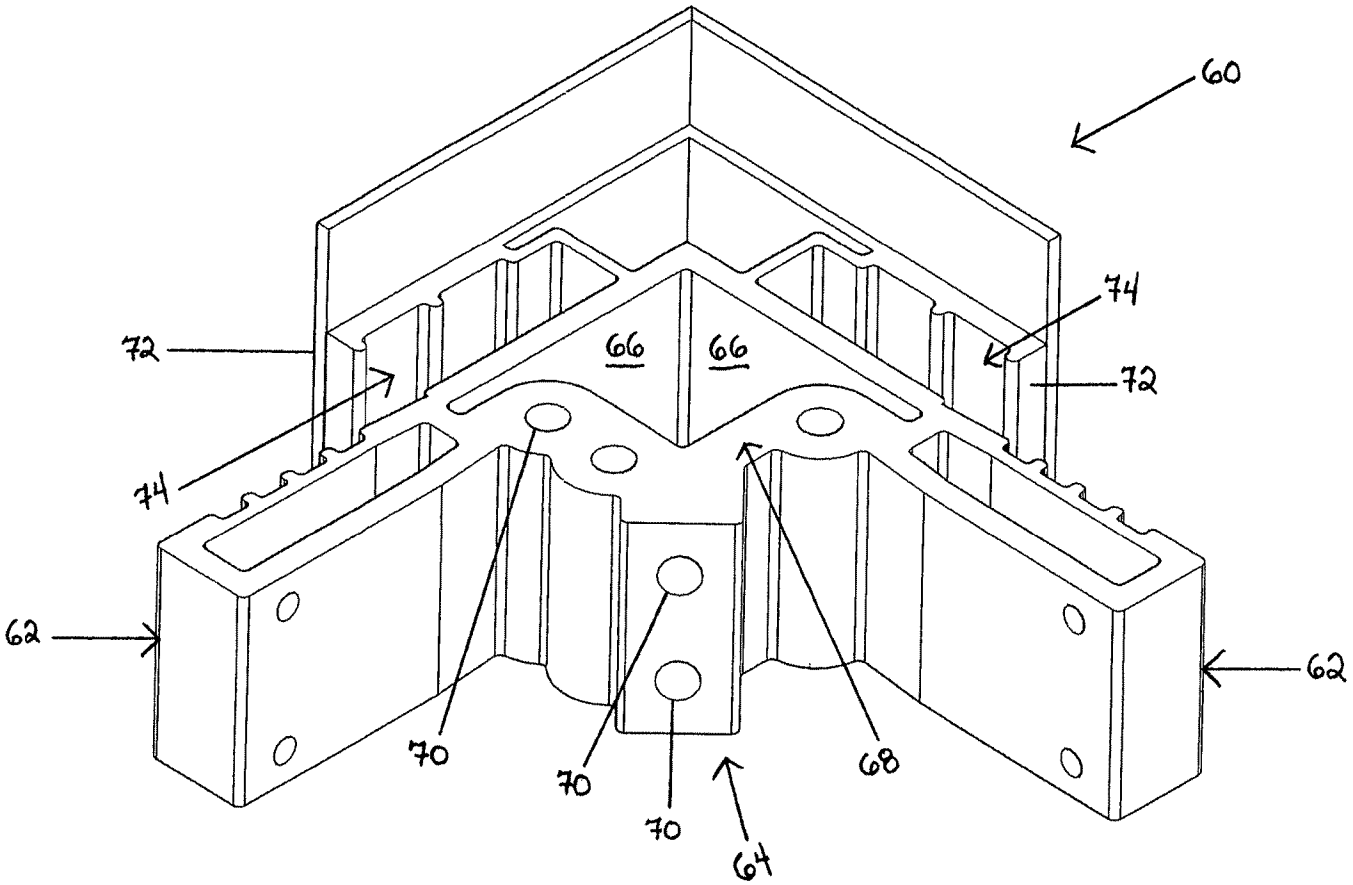
FIG. 7 shows a further connecting device.
Figure 8:
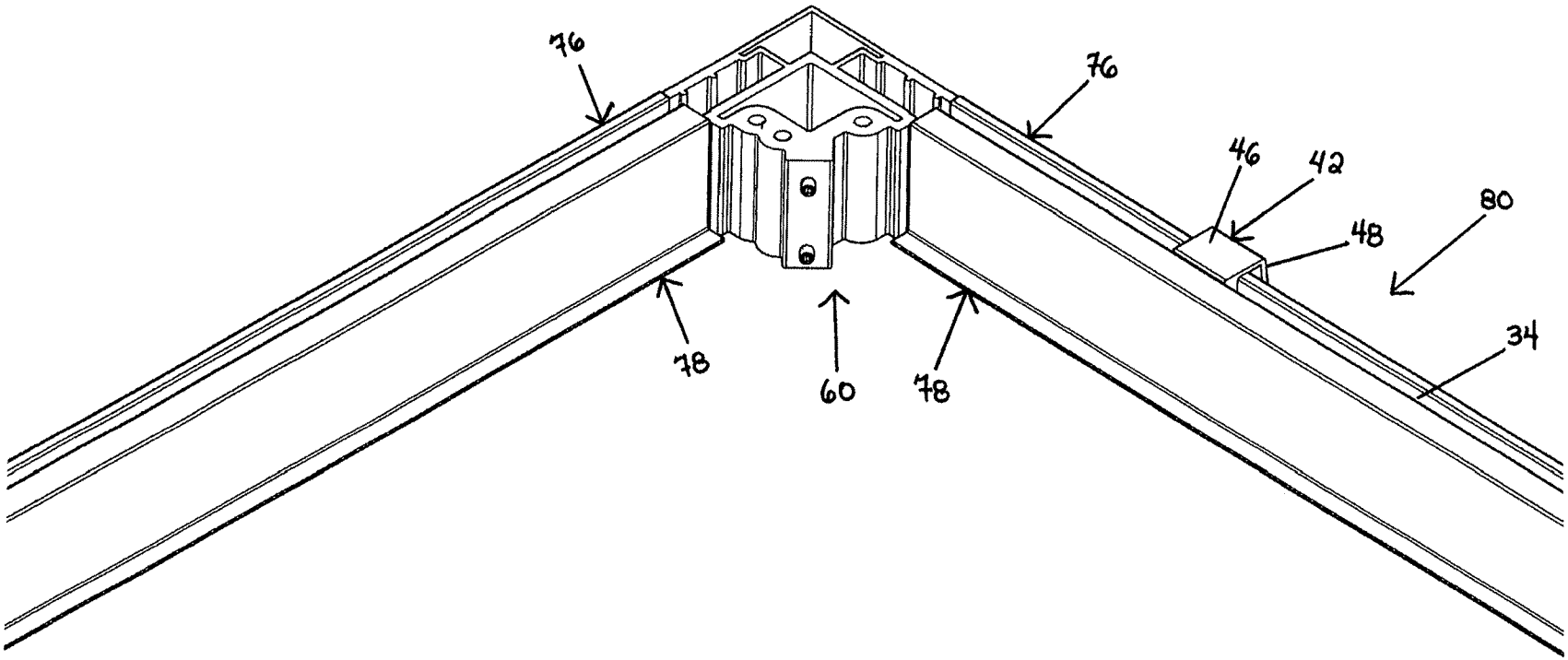
FIG. 8 is a perspective view of the corner of FIG. 7 utilized with frame members.
Figure 9:
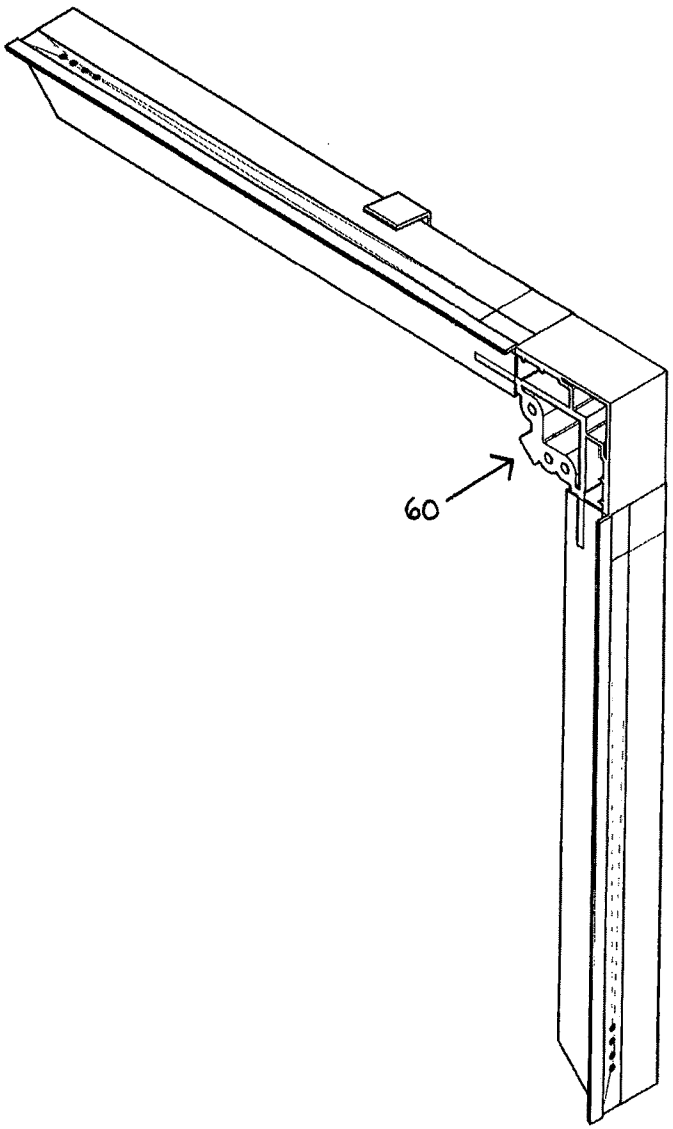
FIG. 9 is a further perspective view thereof.
Figure 10:
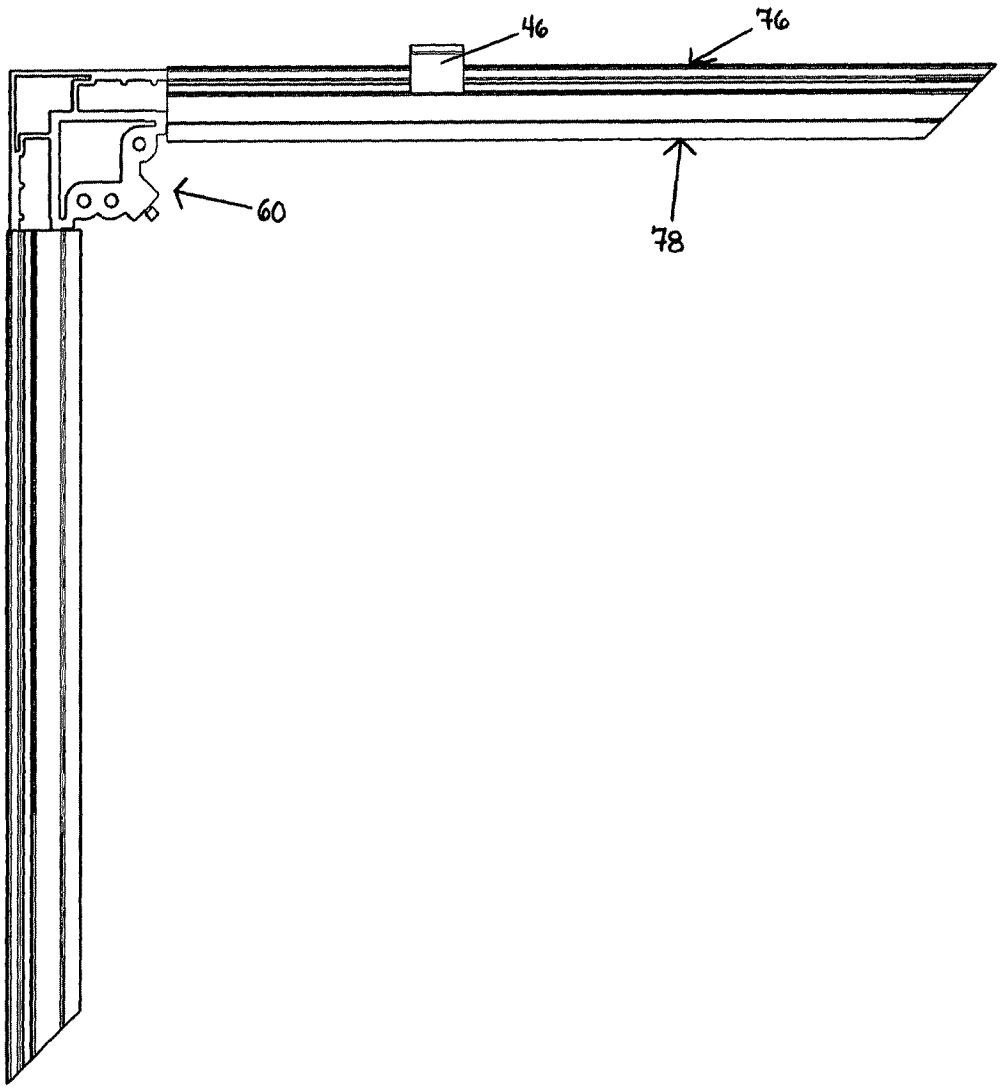
FIG. 10 is a bottom plan view thereof.
Figure 11:
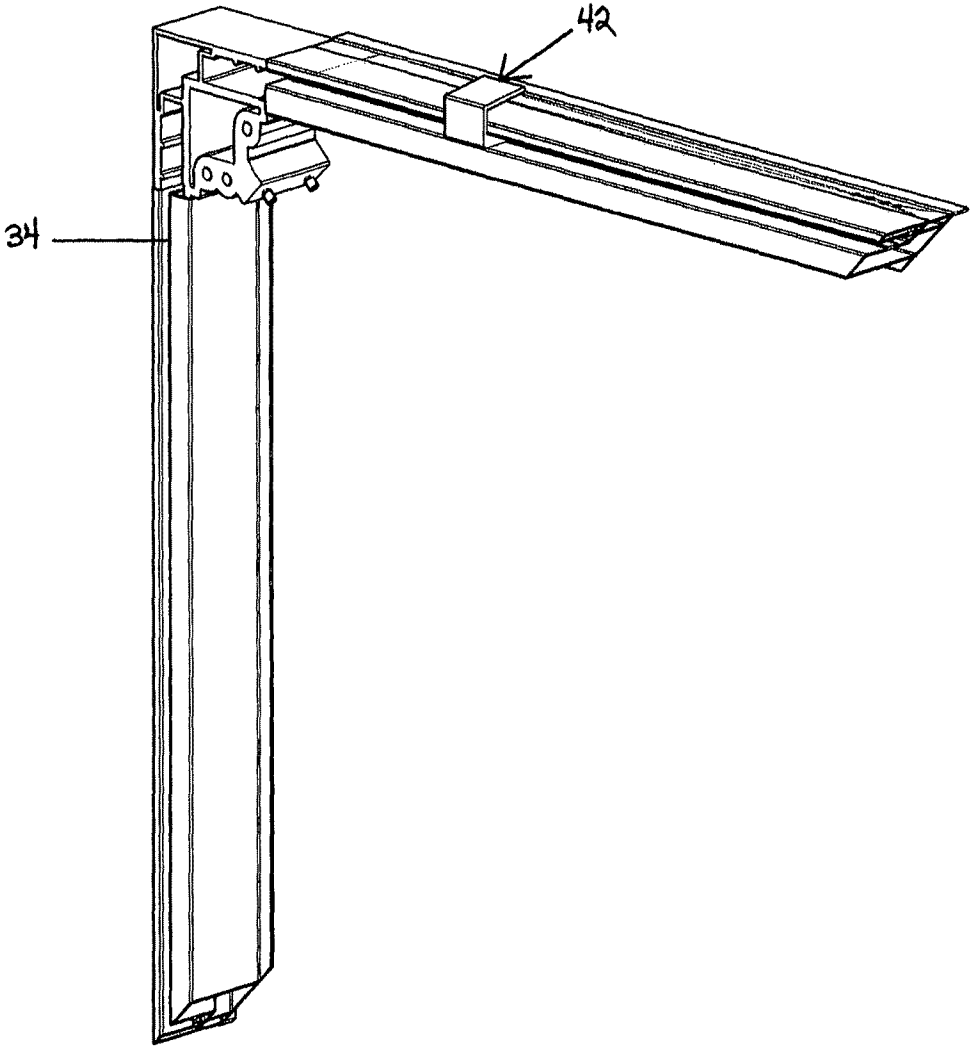
FIG. 11 is a further perspective view thereof.

Referring to FIG. 7, there is illustrated a corner connector which is generally designated by reference numeral 60. Corner connector 60 has a pair of double walled tongues generally designated by reference numeral 62. Each double walled tongue 62 is designed to engage with a frame member as will be discussed hereinbelow.

Corner connector 60 includes an interior corner portion generally designated by reference numeral 64. Interior corner 64 has a pair of interior walls 66 which help define a recess 68. Recess 68 is designed to receive one end of a leg. A plurality of threaded apertures 70 are provided to receive threaded members as previously shown.

Spaced from double walled tongues 62 are exterior or outer walls 72. Defined between outer walls 72 and double walled tongues 62 is a channel 74.

Corner connector 60 is used to connect frame members generally designated by reference numeral 80. Each frame member 80 includes an outer side wall structure 76 and an inner side wall structure 78.

As may be seen, double walled tongues 62 engage interiorly of inner side wall structure 78 while outer walls 72 engage within outer side wall structure 76.

As shown in the drawings, connector element 42 engages with the interior wall of outer side wall structure 76 in the manner shown in FIGS. 5 and 6.

The deck or stage of the present invention has a number of advantages. Thus, any treatment can be done prior to installation and it would be possible to easily disassemble the structure for storage during the winter. Indeed, it would be possible for a homeowner to move the unit the same as furniture. The deck structure can be used in many different locations. As it is built of sturdy material, little maintenance is required.

The preparation of a structure comprising multiple modules is relatively simple. Once the legs are installed on a first module (four legs), a further module may be assembled, this module having only two legs. The outer side wall 76 of the second module will engage within channel 54 of connector element 42. Connector element 42 may be inserted into position through channel 74 and then slid into position. A plurality of such modules may be interconnected together utilizing this structure.

Figure 12:
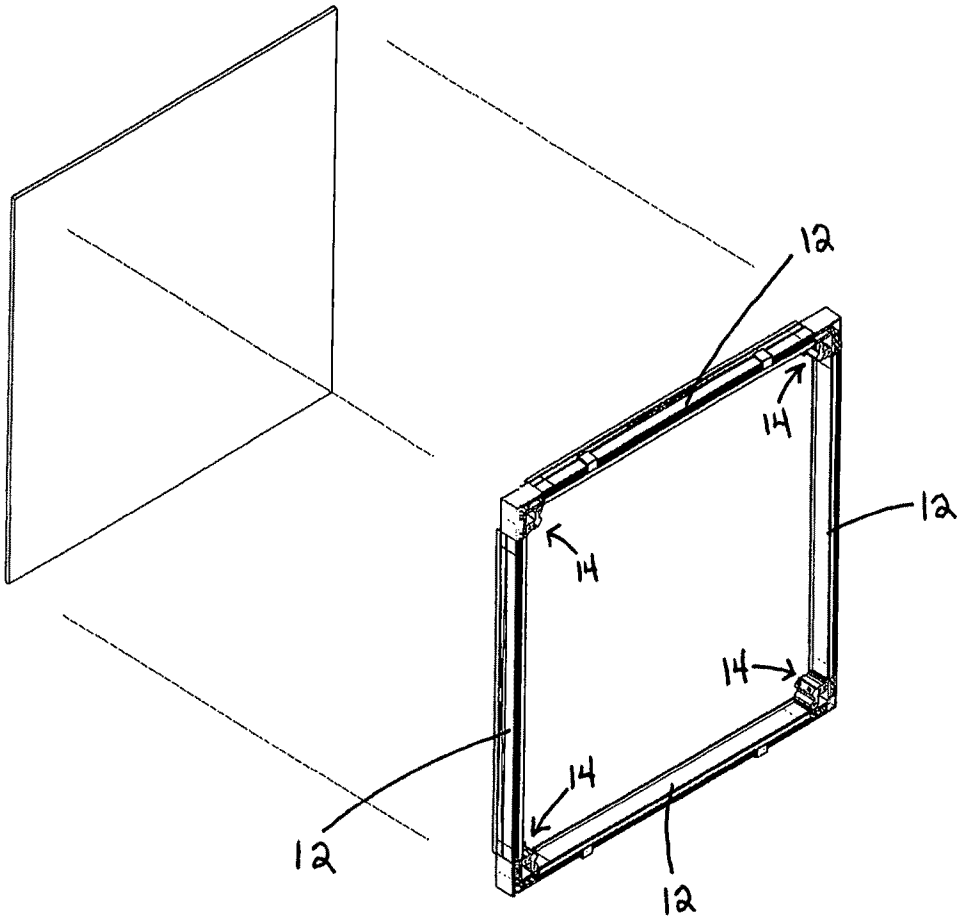
FIG. 12 is a perspective view of the assembly of a frame for the deck.
Figure 13:
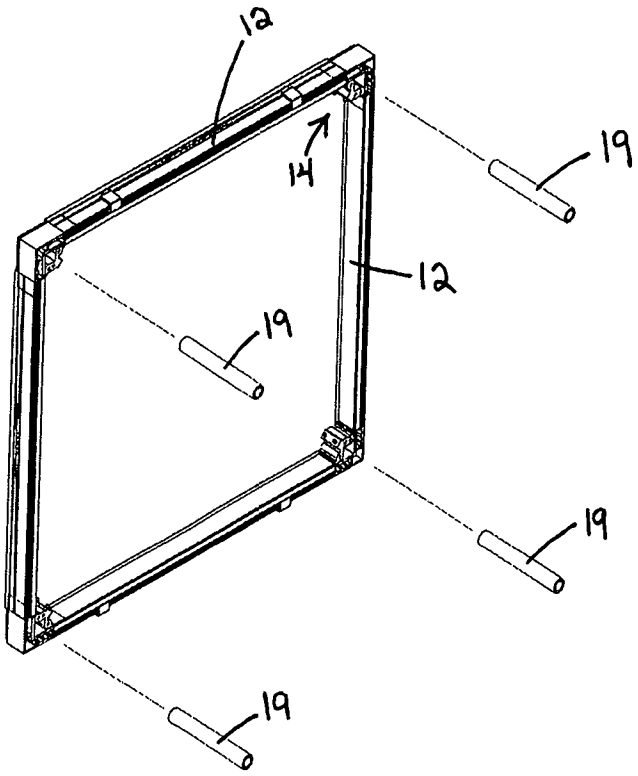
FIG. 13 is a perspective view illustrating the placement of legs in the frame of the deck.
Figure 14:
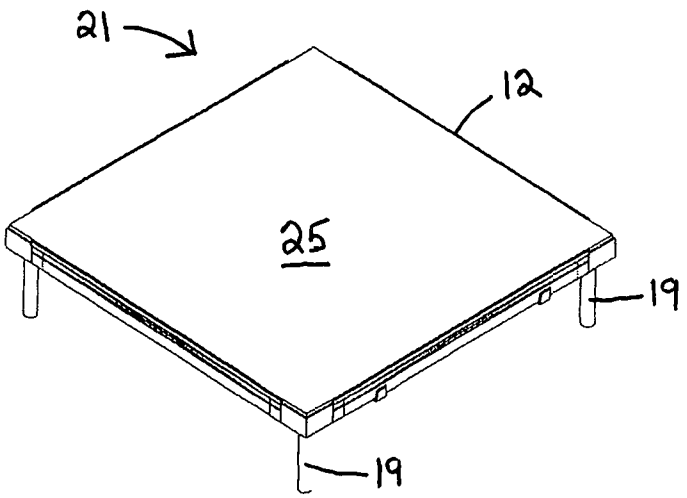
FIG. 14 is a perspective view of a deck segment in an upright position.
Figure 15:
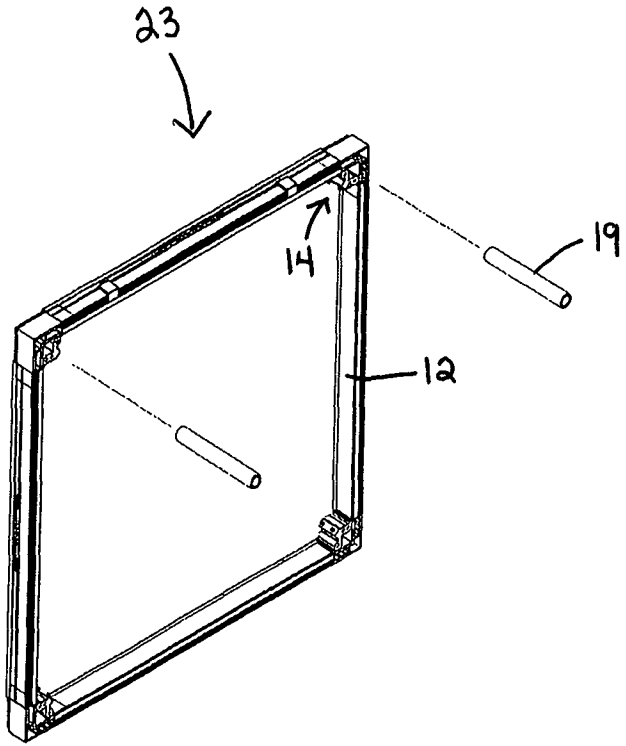
FIG. 15 is a perspective view of the assembly of a second module of the deck.

The assembly of the modules is illustrated in FIGS. 12 to 17. As shown in FIG. 12, one may assemble a first module which comprises a plurality of frame members 12. Frame members 12 are assembled using corner connectors 60 as previously illustrated. Each corner connector 60, as previously mentioned, includes a recess 68 which forms a leg receptor 14. A plurality of legs 19 are inserted in leg receptors 14 as previously discussed. This thus forms a first module 21. A panel 25 forms a top surface of the deck.

Figure 16:
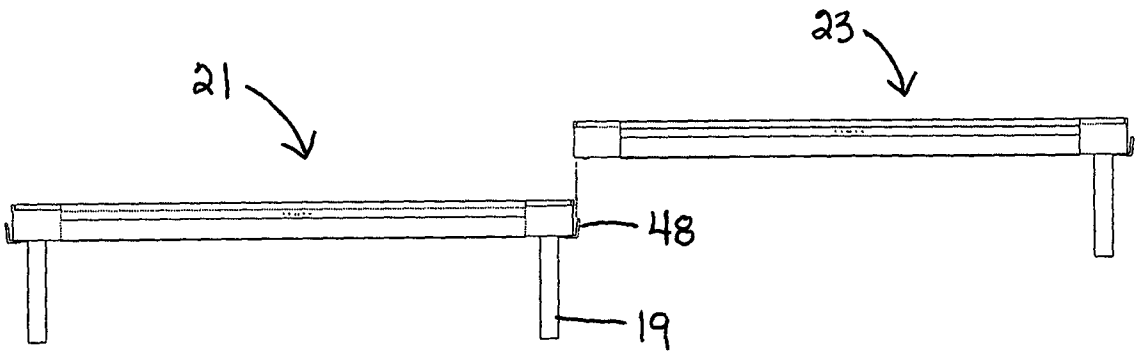
FIG. 16 is a side elevational view illustrating the assembly of the first and second modules together.
Figure 17:
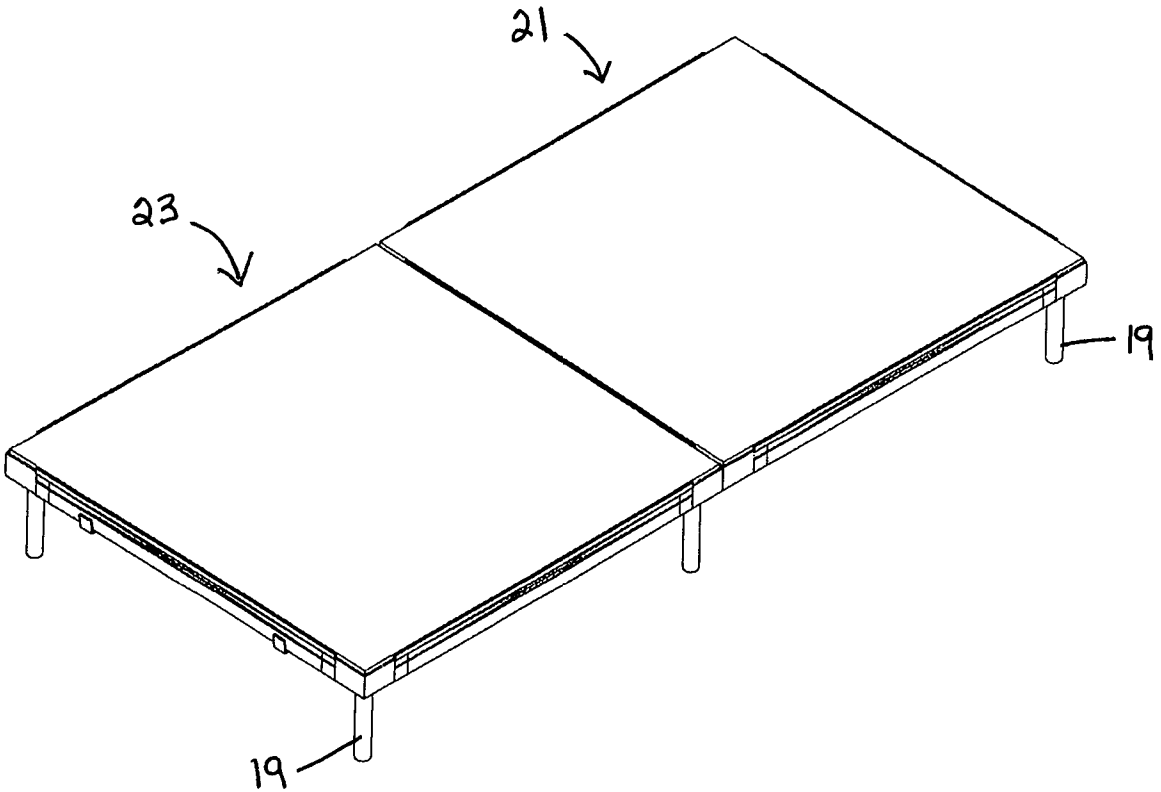
FIG. 17 is a perspective view of the two modules after assembly.

A second module 23 is similarly formed of a plurality of frame members 12 and corner connectors 60. These modules are secured together as shown in FIGS. 16 and 17 with a third leg or upward flange 48 receiving the adjacent module. It will be noted that the second module 23 only requires the insertion of two legs.

It will be understood that the above described embodiment is for purposes of illustration only and that changes and modifications may be made thereto without departing from the spirit and scope of the invention.

I claim:

1. A connector assembly comprising:

a first member having a first side wall, a second side wall, a top wall and a bottom wall;

an opening in said bottom wall, said opening communicating with a vertically extending recess formed within said bottom wall, said recess being bounded by first and second interior walls, each of said first and second interior walls and having a protrusion extending inwardly within the recess towards an opposite interior wall;

a second member comprising a U-shaped element, said U-shaped element having a base, first and second legs, each of said base and first and second legs having an interior and an exterior wall, said first leg having a recess formed in each of said interior and exterior walls, the arrangement being such that said first leg sidingly fits within said recess within said first member, whereby said protrusions on said interior walls engage within said recesses formed in the interior and exterior walls of said first leg, said base of said second member extending below said first member, said second leg of said second element extending upwardly from said base to be adjacent to and spaced from one of said first or second side walls to receive and support an adjacent module.

2. A support structure having a horizontal surface, said support structure comprising first and second modules, said first and second modules each having a rectangular configuration with each module having a side wall, one of said side walls having a connector assembly formed therein, said connector assembly comprising:

a first member having a first side wall, a second side wall, a top wall and a bottom wall;

an opening in said bottom wall, said opening communicating with a vertically extending recess formed within said bottom wall, said recess being grounded by first and second interior walls, each of said first and second interior walls having a protrusion extending inwardly within the recess towards an opposite interior wall;

a second member comprising a U-shaped element, said U-shaped element having a base, first and second legs, each of said base and first and second legs having an interior and an exterior wall, said first leg having a recess formed in each of said interior and exterior walls, the arrangement being such that said first leg sidingly fits within said recess within said first member, whereby said protrusions on said interior walls engage within said recesses formed in the interior and exterior walls of said first leg, said base of said second member extending below said first member, said second leg of said second element extending upwardly from said base to be adjacent to and spaced from one of said side walls to receive and support a side wall of said second module.

* * * * *